US007946310B2

(12) United States Patent
Maillard et al.

(10) Patent No.: US 7,946,310 B2
(45) Date of Patent: May 24, 2011

(54) SYSTEM FOR CONTROLLING A PLURALITY OF TURBOMACHINE DISCHARGE VALVES

(75) Inventors: David Maillard, Bois le Roi (FR); Christophe Claude Philippe Nouhaud, Brie Comte Robert (FR); Philippe Tormo, Savigny le Temple (FR)

(73) Assignee: SNECMA, Paris (FR)

( * ) Notice: Subject to any disclaimer, the term of this patent is extended or adjusted under 35 U.S.C. 154(b) by 149 days.

(21) Appl. No.: 12/463,511

(22) Filed: May 11, 2009

(65) Prior Publication Data

US 2009/0252592 A1 Oct. 8, 2009

Related U.S. Application Data

(62) Division of application No. 11/342,710, filed on Jan. 31, 2006, now abandoned.

(30) Foreign Application Priority Data

Feb. 4, 2005 (FR) ..... 05 01124

(51) Int. Cl.
*F15B 13/044* (2006.01)

(52) U.S. Cl. ..... 137/625.67; 137/554; 137/599.06; 137/625.63; 137/625.65; 251/30.01; 251/129.04

(58) Field of Classification Search ..... 137/554, 137/597, 599.06, 599.09, 625.12, 625.25, 137/625.63, 625.65, 625.67; 251/30.01, 251/129.04

See application file for complete search history.

(56) References Cited

U.S. PATENT DOCUMENTS

| | | | | |
|---|---|---|---|---|
| 2,692,797 | A | 10/1954 | Wood et al. | |
| 2,741,423 | A | 4/1956 | Albert | |
| 3,176,714 | A | 4/1965 | Smith et al. | |
| 3,246,572 | A | 4/1966 | Ogilvie | |
| 3,792,642 | A | 2/1974 | Arai et al. | |
| 3,865,142 | A | 2/1975 | Begun et al. | |
| 3,913,448 | A | 10/1975 | Priestley et al. | |
| 3,938,549 | A | 2/1976 | Nunneley | |
| 4,102,595 | A * | 7/1978 | Wibbelsman | 415/1 |
| 4,391,092 | A | 7/1983 | Arnett | |
| 4,880,031 | A | 11/1989 | Fasolino | |
| 5,226,451 | A * | 7/1993 | Brumfield | 137/625.11 |
| 5,515,673 | A * | 5/1996 | Leclerco et al. | 60/226.3 |
| 5,629,619 | A * | 5/1997 | Mednikov | 324/207.16 |
| 5,647,794 | A | 7/1997 | Ohkubo et al. | |
| 5,941,074 | A * | 8/1999 | Schultz | 60/734 |
| 6,499,506 | B2 | 12/2002 | Feiner | |
| 2002/0013077 | A1 | 1/2002 | Lepine et al. | |
| 2003/0074884 | A1 | 4/2003 | Snow et al. | |
| 2003/0167750 | A1 | 9/2003 | Bornhoft et al. | |

FOREIGN PATENT DOCUMENTS

| | | |
|---|---|---|
| FR | 2 812 350 | 2/2002 |
| GB | 2 174 824 A | 11/1986 |
| WO | WO 03/014577 A1 | 2/2003 |

* cited by examiner

*Primary Examiner* — Stephen M Hepperle
*Assistant Examiner* — William McCalister
(74) *Attorney, Agent, or Firm* — Oblon, Spivak, McClelland, Maier & Neustadt, L.L.P.

(57) ABSTRACT

The invention relates to a pneumatic unit for activating a plurality of discharge valves of a turbomachine, the pneumatic unit having activation outlets corresponding to the number of discharge valves forming said plurality of discharge valves, and a single control input receiving a single control signal from an electronic control unit, the control signal serving to act on a control winding of a manifold means having outlets that form said activation outlets.

16 Claims, 5 Drawing Sheets

15

SYSTEM FOR CONTROLLING A PLURALITY OF TURBOMACHINE DISCHARGE VALVES

CROSS-REFERENCE TO RELATED APPLICATIONS

The present application is a divisional application of U.S. application Ser. No. 11/342,710 filed on Jan. 31, 2006, which claims priority to FR 05 01124 filed on Feb. 4, 2005.

FIELD OF THE INVENTION

The present invention relates to a system for controlling discharge valves in a turbomachine, and it relates more particularly to a pneumatic unit for activating a plurality of discharge valves.

BACKGROUND OF THE INVENTION

In general, a turbomachine comprises an upstream low pressure (LP) compressor and a downstream high pressure (HP) compressor. Both compressors are axial and they rotate at different speeds, often requiring air to be taken from their interface. When idling, in order to protect the upstream compressor from pumping as generated by the mismatch between the speeds of the two compressors, discharge valves are opened to eject the excess air flow generated upstream that cannot be absorbed downstream.

Activation and deactivation of the discharge valves is under the control of a full authority digital electronic control (FADEC) system of the turbomachine.

FIG. 5 shows an example of a prior art control system 115 for controlling the discharge valves 109 of a turbomachine.

That system 115 comprises an electronic control unit (ECU) 117 and a pneumatic control unit (SBU) 118 connected via control lines 145 to N discharge valves 109. The pneumatic unit 118 is fitted with N solenoid valves 129*a*, 129*b*, . . . , 129*n*, having one solenoid valve per discharge valve 109.

A discharge valve 109 that is deactivated (i.e. open) corresponds to the valve being in a rest position.

In order to activate a discharge valve 109 (i.e. close it), the electronic control unit 117 powers the solenoid valve 129*a*, 129*b*, 129*c*, . . . associated therewith which connects the high pressure air 137 at the outlet of the HP compressor to the control line 145 of the discharge valve 109.

The discharge valve 109 has a chamber 143 containing a piston 147 acting against a spring 146. Thus, when the chamber 147 of the piston is fed with high pressure air, the piston 147 moves, compressing the spring 146, and the rod 148 of the piston moves a drive linkage 149 that serves to cause an air exhaust channel 10 to be closed by an internal member 151 of the discharge valve 109.

To reopen the discharge valve 109, the electronic control unit 117 ceases powering the solenoid valve 129*a*, 129*b*, 129*c*, . . . , thereby causing the chamber 143 of the piston to be connected to ambient pressure 139. The spring 146 then returns the piston 147 to the rest position so as to re-open the internal member 151 via the drive linkage 149.

That system nevertheless presents numerous drawbacks. The system is quite complex and the control of the discharge valves 109 frequently busies the electronic control unit 117 which is also used for controlling other important functions of the turbomachine.

Another drawback is the fact that the system does not have any means for directly detecting the position of the discharge valve 109 in order to identify a breakdown (a valve blocked in an open or a closed position). In present systems, a failure is detected by observing the behavior of the turbomachine, which reduces the time available for taking corrective action to prevent pumping. Furthermore, the maintenance assistance functions cannot locate the faulty discharge valve 109.

OBJECT AND SUMMARY OF THE INVENTION

The present invention thus seeks to mitigate the above-mentioned drawbacks and to propose a pneumatic unit for activating a plurality of discharge valves in a turbomachine, the pneumatic unit having activation outlets corresponding to the number of discharge valves making up said plurality of discharge valves, and a single control input receiving a single control signal from an electronic control unit, the control signal serving to act on a control winding of a manifold means whose outlets form said activation outlets.

Thus, the pneumatic unit makes use of a single control signal for controlling all of the discharge valves. This serves to reduce the load on the electronic control unit, thus increasing the reliability and the safety of the turbomachine.

Furthermore, there is no need to have one solenoid valve per discharge valve, thus reducing costs, electricity consumption by the electronic control unit, and overall size of the pneumatic unit.

The manifold means includes a manifold piston separating a cavity communicating with the activation outlets into a first zone at a first feed pressure and a second zone at a second feed pressure, such that when the control winding is powered by the control signal, it causes said manifold piston to move, thereby serving to connect a determined number of said activation outlets to said first feed pressure, with the other outlets being connected to said second feed pressure.

In a first embodiment of the invention, the manifold piston is a slider with the amplitude of its linear displacement being determined by the control signal.

In a second embodiment of the invention, the manifold piston is a rotary piston turned to an angle that is determined by the control signal.

In a particular aspect of the invention, the pneumatic unit further comprises an information return device comprising information return inlets connected to respective corresponding ones of the plurality of discharge valves, the information return device transforming the information returned from the plurality of discharge valves into a single information signal enabling the electronic control unit to determine the activation or deactivation state of each of the discharge valves.

Thus, the information return device enables breakdowns to be detected and any faulty discharge valves to be located.

Advantageously, each of the information return inlets includes a return piston switching between a first resistor and a second resistor depending on the activation or deactivation state of the discharge valve that is connected thereto, the first resistor having an identical resistance for all of the information return inlets, and the second resistor having a resistance that is different for each of the information return inlets, the switching of the return piston at each of the information return inlets enabling one of the first and second resistors of each of the information return inlets to be connected to the others to form an electrical circuit presenting an overall resistance indicative of which discharge valves are genuinely activated.

The first feed pressure is a high pressure and the second feed pressure is ambient pressure.

The invention also provides a control system comprising an electronic control unit, a plurality of discharge valves, and a pneumatic unit having the above-specified characteristics, such that each of the plurality of discharge valves comprises a chamber connected via a pneumatic control line to a respective one of said activation outlets, said chamber containing a transmission piston which, on being displaced, moves a drive linkage causing the corresponding discharge valve to be activated or deactivated.

The discharge valve is in an activated state when the corresponding activation outlet is connected to the high pressure, and in a deactivated state when the corresponding activation outlet is connected to ambient pressure.

Advantageously, the chamber of each of the plurality of discharge valves includes an orifice at the end of the stroke of the transmission piston, enabling high pressure air to be returned to the corresponding information return inlet via a return line.

The single control signal sent by the electronic control unit is a current of magnitude that is modulated as a function of the number of discharge valves to be activated.

Advantageously, all of the discharge valves are in a deactivated state in the event of the electronic control unit failing.

The electronic control unit is also designed to determine the overall resistance of the electrical circuit by measuring the voltage across the terminals of said electrical circuit.

The invention also provides a full authority digital electronic control system for a turbomachine including a control system having the above-specified characteristics.

BRIEF DESCRIPTION OF THE DRAWINGS

Other features and advantages of the method and the apparatus of the invention appear on reading the following description given by way of non-limiting indication and made with reference to the accompanying drawings, in which.

DETAILED DESCRIPTION OF EMBODIMENTS

Figure 1:
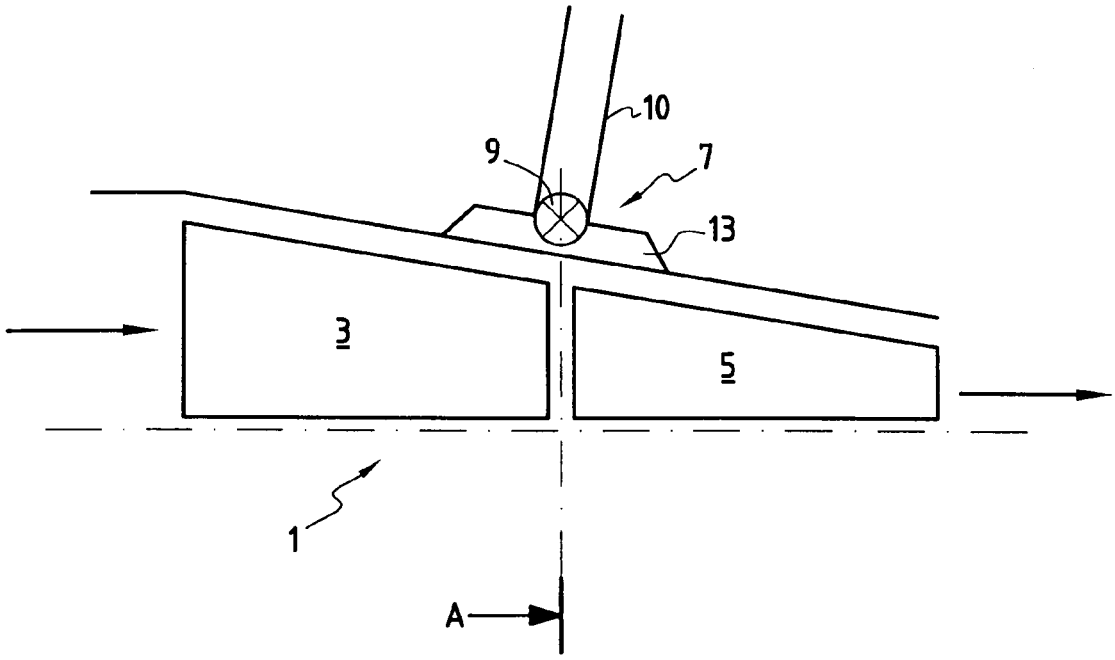
FIG. 1 is a highly diagrammatic fragmentary view of a turbomachine comprising two compressors and a discharge device.
Figure 1A:
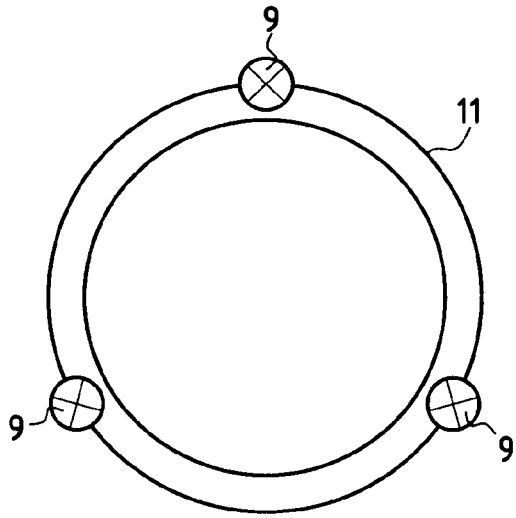
FIG. 1A is a diagrammatic section through the interface between the two compressors of FIG. 1.

FIG. 1 is a highly diagrammatic fragmentary view of a turbomachine 1 including a low pressure (LP) compressor 3 upstream of a high pressure (HP) compressor 5 downstream therefrom. FIG. 1A is a diagrammatic section through the interface between the two compressors 3 and 5 shown in FIG. 1.

In order to improve the conditions of use of the turbomachine, a discharge device 7 is provided comprising on/off-controlled discharge valves 9 distributed around the periphery of the turbomachine 1.

The discharge valves are mounted in the double skin 11 surrounding the interface section between the two compressors 3, 5, forming an air plenum cavity 13 connected to an air exhaust channel 10. The plenum cavity 13 limits the level of disturbance in the air flow section.

The discharge device 7 may be made up of an arbitrary number N of discharge valves 9. Preferably, the number N of discharge valves 9 lies in the range two to ten.

Each discharge valve 9 is dimensioned so as to take 1/Nth of the total maximum flow rate that needs to be taken. The discharge device thus relies on control logic of the following type:

If percentage of the flow rate to be taken <1/N
then open 1 valve
If 1/N<percentage of the flow rate to be taken <2/N
then open 2 valves
If i/N<percentage of the flow rate to be taken <i+1/N
then open i+1 valves
If (N−1)/N<percentage of the flow rate to be taken
then open N valves.

Figure 2:
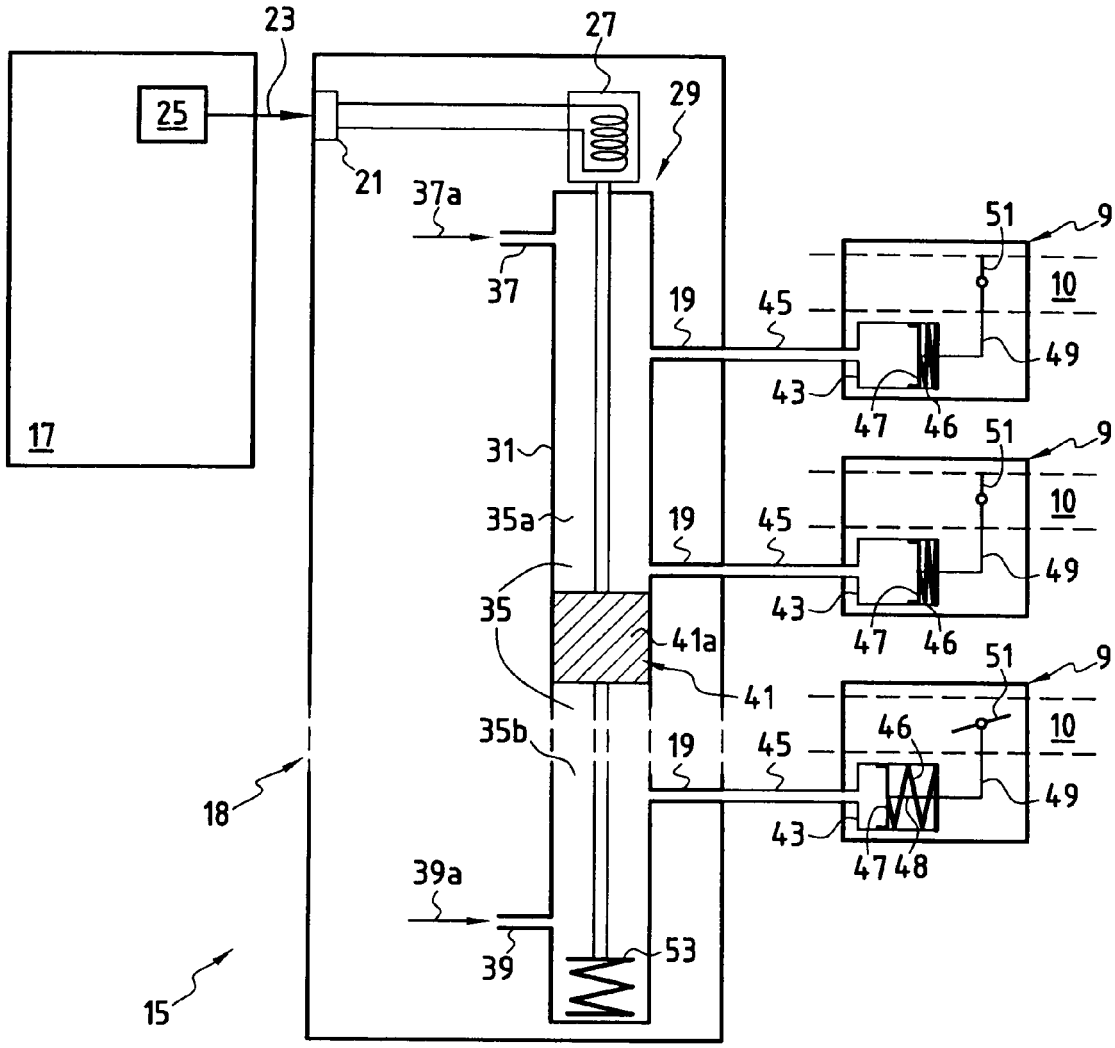
FIG. 2 is a highly diagrammatic view of a control system comprising an electronic control unit, a plurality of turbomachine discharge valves, and a pneumatic unit in accordance with the invention for activating the plurality of discharge valves.

In accordance with the invention, FIG. 2 is a highly diagrammatic view of a control system 15 comprising an electronic control unit 17, a plurality of discharge valves 9 in a turbomachine 1, and a pneumatic unit 18 for activating the plurality of discharge valves 9.

The pneumatic unit 18 has activation outlets 19 corresponding to the number N of discharge valves 9 forming the plurality of discharge valves 9, i.e. each activation outlet 19 corresponds to one discharge valve 9.

In addition, the pneumatic unit 18 has a single control input 21 receiving a control signal 23 from a channel 25 of the electronic control unit 17. This control signal 23 acts on a control winding 27 of a manifold means 29 whose outlets form said activation outlets 19.

The single control signal 23 delivered by the electronic control unit 17 is a direct current (DC) of magnitude that is modulated as a function of the number of discharge valves 9 to be activated. Thus, a single channel 25 of the electronic control unit 17 suffices to control all of the discharge valves 9.

The manifold means 29 comprises a chamber 31 forming a cavity 35 communicating with the activation outlets 19 and with a first feed pressure 37 and a second feed pressure 39.

In addition, the manifold means 29 includes a manifold piston 41 suitable for separating the cavity 35 into a first zone 35*a* at the first feed pressure and a second zone 35*b* at the second feed pressure.

When the control winding 27 is powered by the control signal 23, an electromagnetic field is generated that acts by induction to move the manifold piston 41, thereby enabling a determined number of the activation outlets 19 to be connected to the first feed pressure 37 so as to activate the same determined number of discharge valves 9. In contrast, the other outlets are connected to the second feed pressure 39.

In general, the first feed pressure 37 is a high pressure and the second feed pressure 39 is an ambient pressure.

The air from the high pressure compressor 5 is taken as a high pressure feed source 37*a*, while ambient pressure is taken from a connection 39*a* to the surrounding air.

Each of the plurality of discharge valves 9 comprises a chamber 43 connected via a pneumatic control line 45 to a respective one of the activation outlets 19. Each chamber 43 includes a transmission piston 47 which, on being displaced, drives movement of a drive linkage 49 acting on an internal member 51 that closes or opens the duct 10, i.e. activates or deactivates the corresponding discharge valve 9.

It should be observed that the discharge valve 9 is in an activated state (valve closed) when the corresponding activation outlet 19 is connected to the high pressure 37, and that it is in a deactivated state (valve open) when the corresponding activation outlet 19 is connected to ambient pressure 39.

When the chamber 43 of a discharge valve 9 is fed with high pressure air 37, then its transmission piston 47 moves to compress a spring 46, and the piston rod 48 moves the drive linkage 49 causing the air exhaust channel 10 to be closed by the internal member 51 of the corresponding discharge valve 109.

In contrast, when the chamber 43 of a discharge valve 9 is fed with air at ambient pressure 39, then the spring 46 returns the transmission piston 47 to its rest position so as to re-open the butterfly valve 51 via the drive linkage 49.

In the example of FIG. 2, the manifold piston 41 is a slider comprising a piston 41*a* connected to a counteracting spring 53. The piston 41*a* moves in translation in a manifold chamber 31 of cylindrical shape having a generator line of length proportional to the number N of discharge valves 9. The high pressure air inlet 37 is placed at one end of the manifold chamber 31, while the ambient pressure air inlet 39 is placed at the other end of said chamber 31. Furthermore, the activation outlets 19 are disposed at regular intervals between the high pressure inlet 37 and the low pressure inlet 39.

Amplitude of the linear displacement of the slider 41 is determined by the control signal 23, and its position is stabilized by the counteracting spring 53.

Thus, a given position of the slider 41 corresponds to a given number of the discharge valves 9 being closed. The position of the slider 41 is itself determined by the magnitude of the current of the control signal 23. Consequently, the current control coming from the electronic control unit 17 serves to close the desired number of discharge valves 9.

In the example of FIG. 2, the slider 41 presents a position enabling two discharge valves 9 to be closed.

It should be observed that in the event of the electronic control unit 17 failing or being lost, the counteracting spring 53 returns the slider 41 into a position corresponding to all of the discharge valves 9 being open (the deactivated state), which prevents any pumping while the compressors are decelerating.

Advantageously, the electrical portion of the manifold means 29 is made redundant so that each channel from the electronic control unit 17 can control all of the discharge valves 9 in independent manner.

Figure 3:
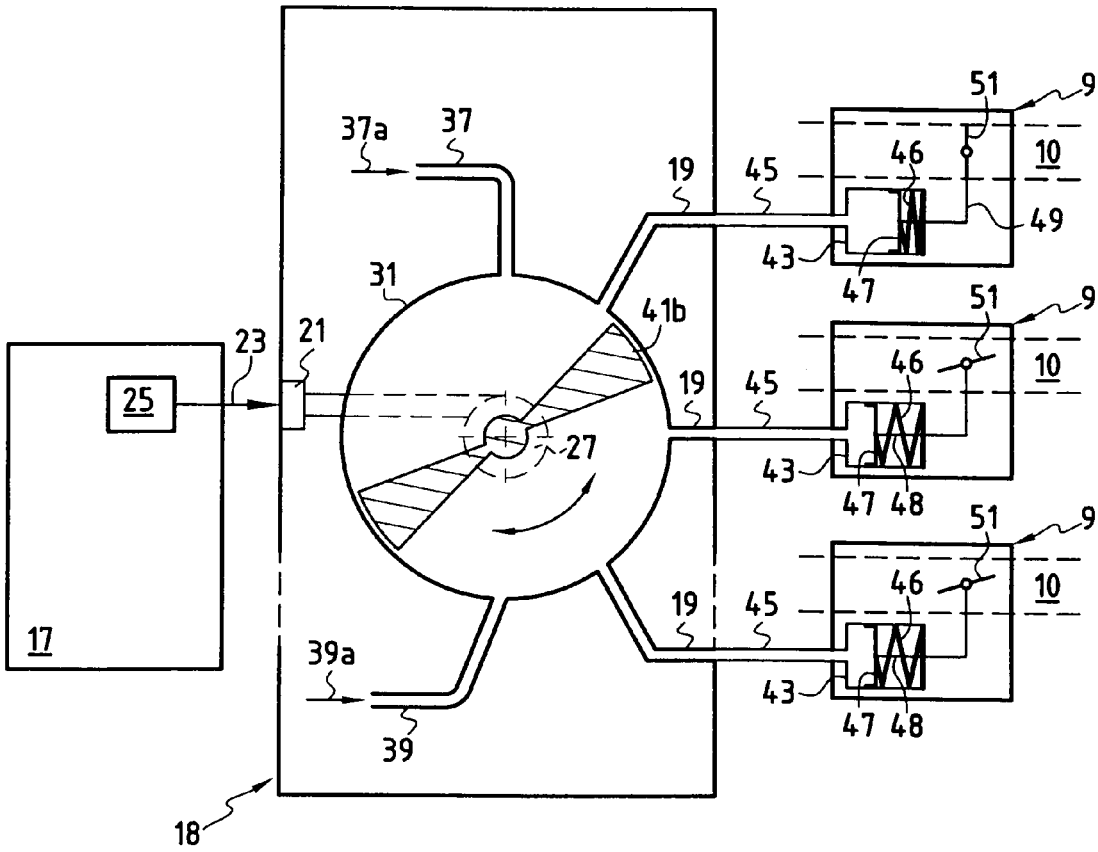
FIG. 3 shows a variant of FIG. 2.

FIG. 3 shows a variant of FIG. 2, showing highly diagrammatically a system for controlling a plurality of discharge valves 9. The example of FIG. 3 differs from that of FIG. 2 in that the manifold piston is a rotary piston 41*b* capable of turning inside a manifold chamber 31 having a diameter of a length that is proportional to the number N of discharge valves 9.

The single control signal 23 acts on the control winding 27 of the rotary piston 41*b*. The control winding 27 can be integrated in known manner in a stepper motor so as to act on the angular orientation of the rotary piston 41*b*.

By way of example, the rotary piston 41*b* may be in the form of a butterfly valve whose angular orientation corresponds to a given number of the discharge valves 9 being closed.

The high pressure air inlet 37 and the ambient pressure inlet 39 are disposed in diametrically opposite positions. Furthermore, the activation outlets 19 can be disposed at regular intervals over half of the circumference of the manifold chamber 31 between the high pressure inlet 37 and the ambient pressure inlet 39.

The angular position of the rotary piston 41*b* is itself determined by the magnitude of the current constituting the control signal 23. Consequently, the current control coming from the electronic control unit 17 serves to close the desired number of discharge valves 9.

The example of FIG. 3 shows a rotary piston 41*b* presenting an angular position that enables a single discharge valve 9 to be closed.

Figure 4:
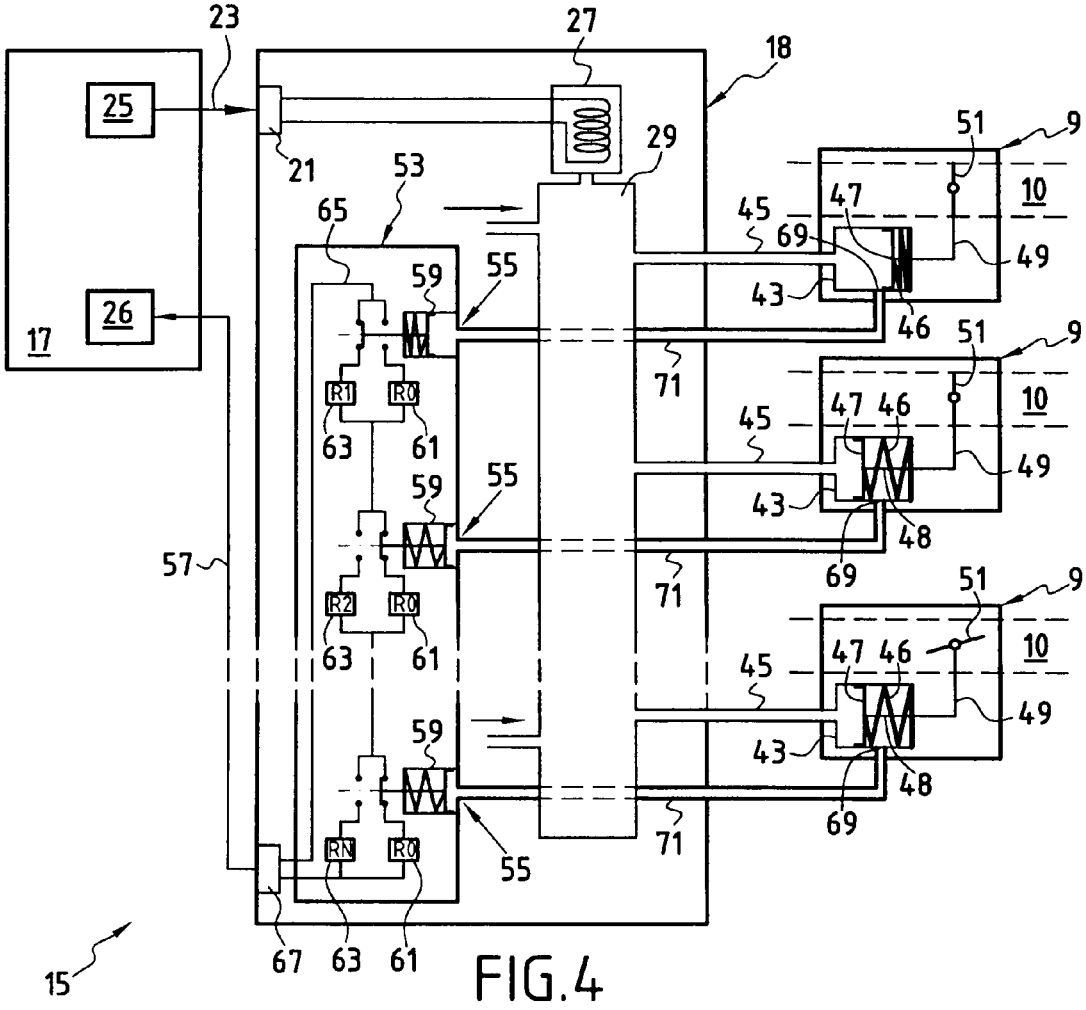
FIG. 4 is a highly diagrammatic view of a control system as shown in FIG. 2 or FIG. 3 and further including an information return device.
Figure 5:
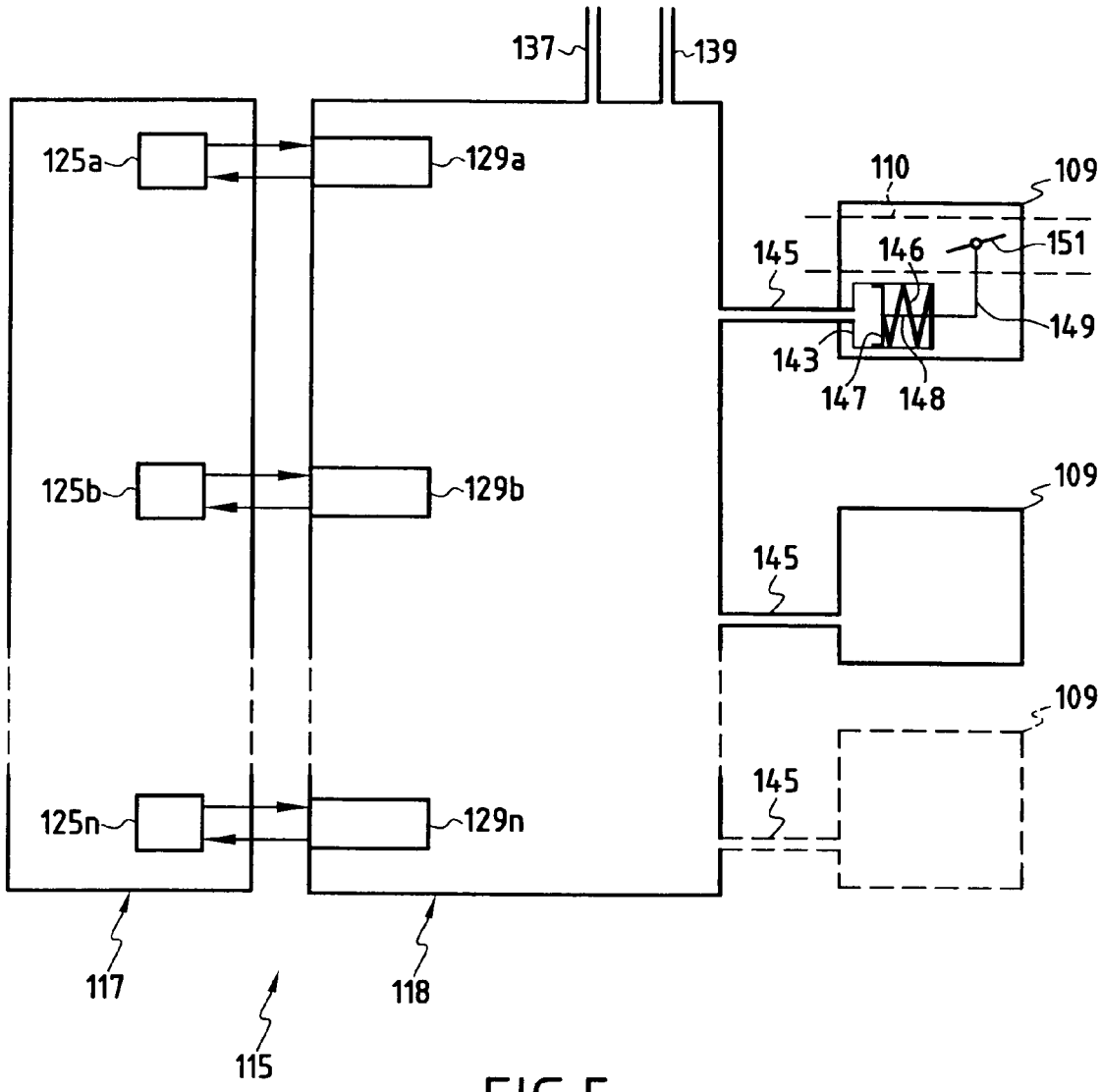
FIG.5 PRIOR ART
FIG. 5 is a highly diagrammatic view of a prior art control system.

FIG. 4 is a highly diagrammatic view of a control system 15 for a plurality of discharge valves 9 and including an information return device 53.

The pneumatic unit 18 in FIG. 4 differs from that in FIG. 2 or FIG. 3 by the fact that it further comprises an information return device 53 having inlets 55 for returning pneumatic information and connected to corresponding respective ones of the plurality of discharge valves 9.

The information return device 53 serves to indicate an activation state (closed) or a deactivation state (open) for each of the discharge valves 9. Consequently, any faulty discharge valve 9 can be located immediately.

The information return device 53 transforms the pneumatic information returned from the plurality of discharge valves 9 into a single information signal 57 enabling the electronic control unit 17 to determine the activation or deactivation state of each of the discharge valves 9.

Consequently, it suffices to allocate a single channel 26 of the electronic control unit 17 to measuring the single information signal 57 delivered by the pneumatic unit 18.

By way of example, each of the information return inlets 55 includes a return piston 59 that switches between a first resistor 61 and a second resistor 63 depending on the activation or deactivation state of the discharge valve 9 to which it is connected. The first resistor 61 possesses the same resistance R0 in all of the information return inlets 55. The second resistor 63 possesses a resistance R1, R2, . . . , Ri, . . . , RN that is different for each of the information return inlets 55 and that is also different from the resistance of the first resistor 61, i.e. R0≠R1≠R2≠ . . . ≠Ri≠ . . . ≠RN.

The switching of the return piston 59 in each of the information return inlets 55 serves to connect together and in series one or the other of the first and second resistors 61, 63 of each of the information return inlets 55 so as to form an electrical circuit 65 whose total resistance is indicative of the real activation state of the discharge valves 9. It should also be observed that the resistors of the electrical circuit 65 could equally well be connected in parallel.

The electronic control unit 17 feeds the electrical circuit 65 with current that flows through the N resistors switched into circuit (one per valve) and it acts via an interface 67 of the pneumatic unit 18 to measure the voltage across the terminals of said electrical circuit 65 in order to determine the overall resistance of said circuit 65.

The piston chamber 43 of each of the plurality of discharge valves 9 includes an orifice 69 at the end of the stroke of the transmission piston 47 enabling high pressure air to return to the corresponding information return inlet 55 via a return line 71.

Thus, when the pneumatic unit 18 delivers high pressure air to the control line 45 of the discharge valve 9 in order to close it, the movement in translation of the transmission piston 47 at the end of its stroke uncovers the orifice 69 which returns high pressure air to the information return device 53 via the dedicated return line 71. At the inlet of said return line 71 to the pneumatic unit 18, the return piston 59 of the inlet 55 moves in translation under the effect of the pressure and switches the resistance associated with the discharge valves 9 from R0 to Ri (where Ri is the resistance of second resistor 63 of the corresponding information return inlet 55). The resistance read by the electronic control unit 17 is thus modified, thereby indicating that the discharge valve 9 has closed. In this example, the default value of the resistance associated with an open discharge valve 9 is R0.

It should be observed that the resistances associated with the various discharge valves 9 are different so as to make it possible immediately (within the limit of the response time of the electronic control unit 17) to detect that a discharge valve 9 has become blocked and to locate which valve 9 is faulty for the purpose of subsequent maintenance operations.

Advantageously, the electrical portion of the information return device 53 is made redundant so as to enable each channel of the electronic control unit 17 to read the overall resistance of the electrical circuit 63 independently.

The control system 15 of the invention thus enables a plurality of on/off type discharge valves 9 to be controlled by a single electrical signal 23.

Likewise, it enables the positions of the discharge valves 9 to be read by a single information signal 57. It thus enables any faulty discharge valve 9 to be located while reducing the time required to detect that a valve is faulty.

In addition, the control system 15 makes it possible to reduce the number of electronic control circuits devoted to controlling the discharge valves 9.

The control system 15 also makes it possible to reduce the amount of electricity consumed by the electronic control unit 17.

Naturally, the above-described control system 15 is integrated within a full authority digital electronic control (FADEC) system of the turbomachine 1.

What is claimed is:

1. A system comprising a plurality of discharge valves adapted to be used in a turbomachine, a pneumatic unit for activating said plurality of discharge valves, and an information return device, wherein said pneumatic unit comprises:

activation outlets corresponding to the number of discharge valves forming said plurality of discharge valves, and a single control input receiving a single control signal from an electronic control unit, the control signal being designed to act on a control winding of a manifold means having outlets that form said activation outlets; and wherein said information return device comprises information return inlets connected to respective corresponding ones of the plurality of discharge valves, the information return device transforming information returned from the plurality of discharge valves into a single information signal enabling the electronic control unit to determine the activation or deactivation state of each of the discharge valves, wherein each of the information return inlets includes a return piston switching between a first resistor and a second resistor depending on the activation or deactivation state of the discharge valve that is connected thereto, the first resistor having an identical resistance for all of the information return inlets, and the second resistor having a resistance that is different for each of the information return inlets, wherein switching of the return piston at each of the information return inlets enables one of the first and second resistors of each of the information return inlets to be connected to the others to form an electrical circuit presenting an overall resistance indicative of which discharge valves are genuinely activated.

2. A system according to claim 1, wherein said manifold means includes a manifold piston that subdivides a cavity in communication with the activation outlets into a first zone at a first feed pressure, and a second zone at a second feed pressure, such that when the control winding is powered by the control signal, said control winding causes said manifold piston to move, thereby enabling a determined number of said activation outlets to be connected to said first feed pressure, with the other outlets than being connected to said second feed pressure.

3. A system according to claim 2, wherein the manifold piston includes a slider, wherein an amplitude of a linear displacement of said slider is determined by the control signal.

4. A system according to claim 2, wherein the manifold piston is a rotary piston turned to an angle that is determined by the control signal.

5. A system according to claim 2, wherein the first feed pressure is a high pressure and the second feed pressure is an ambient pressure.

6. A control system according to claim 1, wherein the discharge valve is in an activated state when the corresponding activation outlet is connected to high pressure.

7. A control system according to claim 1, wherein the discharge valve is in a deactivated state when the corresponding activation outlet is connected to low pressure.

8. A control system according to claim 1, wherein a chamber of each of the plurality of discharge valves includes an orifice, enabling high pressure air to be returned to a corresponding information return inlet via a return line.

9. A control system according to claim 1, wherein the single control signal sent by the electronic control unit is a current of magnitude that is modulated as a function of the number of discharge valves to be activated.

10. A control system according to claim 1, wherein all of the discharge valves are in a deactivated state in the event of the electronic control unit failing.

11. A control system according to claim 1, wherein the electronic control unit is configured to determine the overall resistance of the electrical circuit by measuring a voltage across terminals of said electrical circuit.

12. A system according to claim 1, wherein said manifold means includes a single manifold with a single control winding controlled by said single control signal, wherein said single control winding moves a single manifold piston, said single manifold having said activation outlets, each of said activation outlets being in communication respectively with one of said discharge valves such that said single manifold activates said plurality of discharge valves.

13. A system according to claim 12, wherein said single control signal is a direct current of magnitude that is modulated as a function of said determined number of said activation outlets connected to said first feed pressure.

14. A system according to claim 12, wherein a position of said single manifold piston determines said determined number of said activation outlets connected to said first feed pressure.

15. A system according to claim 1, further comprising a low pressure compressor and a high pressure compressor that rotate at different speeds, wherein said discharge valves are opened in order to protect said low pressure compressor by ejecting excess air flow generated by a mismatch of said different speeds.

16. A system according to claim 15, wherein said first feed pressure is provided from said high pressure compressor and said second feed pressure is provided from air surrounding said turbomachine.

* * * * *